US008141620B1

(12) United States Patent
Zrodnikov et al.

(10) Patent No.: US 8,141,620 B1
(45) Date of Patent: Mar. 27, 2012

(54) METHOD FOR CONDITIONING A COOLING LOOP OF A HEAT EXCHANGE SYSTEM

(75) Inventors: Volodymyr Zrodnikov, Chico, CA (US); James M. Kerner, Chico, CA (US); Michael Spokoiny, Chico, CA (US)

(73) Assignee: United States Thermoelectric Consortium (USTC), Chico, CA (US)

( * ) Notice: Subject to any disclaimer, the term of this patent is extended or adjusted under 35 U.S.C. 154(b) by 1244 days.

(21) Appl. No.: 11/711,440

(22) Filed: Feb. 26, 2007

(51) Int. Cl.
*F28D 15/00* (2006.01)
*F16F 1/34* (2006.01)
*F28G 1/12* (2006.01)

(52) U.S. Cl. .... 165/104.32; 165/71; 165/95; 165/134.1; 62/303

(58) Field of Classification Search ..... 165/70, 165/71, 95, 104.32, 134.1; 62/303; 237/80
See application file for complete search history.

(56) References Cited

U.S. PATENT DOCUMENTS 2,764,943 A * 10/1956 Peters ..... 165/104.32
2,937,923 A * 5/1960 Shapleigh ..... 165/70
3,229,763 A 1/1966 Rosenblad
4,012,490 A * 3/1977 Lofredo ..... 62/925
4,177,858 A * 12/1979 Daman et al. ..... 165/70
4,190,099 A * 2/1980 Despois et al. ..... 165/104.32
4,934,390 A * 6/1990 Sapp ..... 62/303
4,938,280 A 7/1990 Clark
5,021,924 A 6/1991 Kieda
5,044,166 A * 9/1991 Wijmans et al. ..... 62/85
5,131,233 A 7/1992 Cray
5,170,319 A 12/1992 Chu
5,183,104 A 2/1993 Novotny
5,220,804 A 6/1993 Tilton
5,224,538 A 7/1993 Jacoby
5,269,146 A 12/1993 Kerner
5,375,426 A * 12/1994 Burgener ..... 62/303
5,412,536 A 5/1995 Anderson
5,718,119 A * 2/1998 Wakita et al. ..... 62/303
5,781,411 A 7/1998 Feenstra
5,831,824 A 11/1998 McDunn
6,141,214 A 10/2000 Ahn
6,173,758 B1 1/2001 Ward
6,343,012 B1 1/2002 Rife
6,366,462 B1 4/2002 Chu
6,401,807 B1 6/2002 Wyler
6,434,953 B2 * 8/2002 Bimboes et al. ..... 62/77
6,469,898 B1 10/2002 Rouchon
6,650,538 B1 11/2003 Chu
6,666,260 B2 12/2003 Tantoush (Continued)

OTHER PUBLICATIONS

Ekkad et al., Dimple Enhanced Heat Transfer in High Aspect Ratio Channels, J. Enhanced Heat Trans., 2003, pp. 395-405, vol. 10(4).

(Continued)

*Primary Examiner* — Ljiljana Ciric
(74) *Attorney, Agent, or Firm* — The Webostad Firm

(57) ABSTRACT

Use of an inert gas in a fluid-operated heat exchange system. A cooling loop of a heat exchange system is purged with an inert gas to remove oxygen from the cooling loop. Coolant is added to the cooling loop of the heat exchange system. The coolant flows in the cooling loop of the heat exchange system to mix the inert gas with the coolant to provide a solution having a reduced concentration of oxygen.

10 Claims, 10 Drawing Sheets

U.S. PATENT DOCUMENTS

| | | | |
|---|---|---|---|
| 6,671,172 | B2 | 12/2003 | Carter |
| 6,729,383 | B1 | 5/2004 | Cannell |
| 6,817,405 | B2 | 11/2004 | Kamath |
| 6,820,684 | B1 | 11/2004 | Chu |
| 6,914,782 | B2 | 7/2005 | Ku |
| 6,940,718 | B2 | 9/2005 | Gedamu |
| 6,973,801 | B1 | 12/2005 | Campbell |
| 6,988,534 | B2 | 1/2006 | Kenny |
| 7,000,684 | B2 | 2/2006 | Kenny |
| 2003/0011987 | A1 | 1/2003 | Chu |
| 2003/0183368 | A1 | 10/2003 | Paradis |
| 2003/0226371 | A1 | 12/2003 | Rini |
| 2004/0108101 | A1 | 6/2004 | Dugas |
| 2004/0150956 | A1 | 8/2004 | Conte |
| 2005/0047105 | A1 | 3/2005 | Gedamu |
| 2006/0042825 | A1 | 3/2006 | Lu |
| 2006/0092235 | A1 | 5/2006 | Sugahara |
| 2006/0126296 | A1 | 6/2006 | Campbell |

OTHER PUBLICATIONS

Isaev et al., Numerical Analysis of the Jet-Vortex Pattern of Flow in a Rectangular Trench, J. Eng. Phys. & Thermophys., 2003, pp. 61-69, vol. 76(1).

Patrick, W.V., Computations of Flow Structures and Heat Transfer in a Dimpled Channel at Low to Moderate Reynolds Number, Apr. 25, 2005, Master's Thesis, Virginia Polytechnic Institute and State University.

Syred et al., Effect of Surface Curvature on Heat Transfer and Hydrodynamics Within a Single Hemispherical Dimple, J. Turbomachinery, Jul. 2001; pp. 609-613, vol. 123.

* cited by examiner

METHOD FOR CONDITIONING A COOLING LOOP OF A HEAT EXCHANGE SYSTEM

FIELD OF THE INVENTION

One or more aspects of the invention relate generally to reliability and longevity of a heat exchange system and, more particularly, to use of an inert gas in a fluid-operated heat exchange system.

BACKGROUND OF THE INVENTION

A continuing trend in the electronics, automobile, avionics, and spacecraft industries, among other industries, is to create more and more compact apparatuses leading to an increase in the power density of such apparatuses. Accordingly, as the power density of such apparatuses increases, there may be a corresponding increase in thermal energy to be dissipated for operability of such apparatuses. Notably, the size of such apparatuses, as well as the systems in which they are implemented, may impose additional constraints on the size of heat transfer devices used to transport such heat away.

Conventional fluid-operated heat exchange systems include passageways through which a medium, such as fluid coolant, is caused to flow in order to transport heat. As a result of an increase in the amount of thermal energy to be transported, complexity associated with heat transfer devices has increased. This increase in thermal energy to be transported in some instances has lead to the narrowing of channels in which the coolant is flowed.

A problem in some fluid-operated heat exchange systems is caused by the presence of air in a cooling loop of such system interacting with the coolant. Air, as is generally known, includes oxygen. While not wishing to be bound by theory, it is believed that the interaction of the oxygen and coolant with inner surfaces, such as inner metallic surfaces, of the cooling loop may accelerate an electrochemical reaction in the cooling loop. The acceleration of these reactions may result in one or both of oxidation of the coolant and corrosion of inner surfaces of materials of the cooling loop. Corrosion may reduce longevity, performance, and reliability, such as, for example, due to internal generation of particulate clogging coolant channels, or material fatigue due to thermo-acoustic oscillations in a cooling loop causing false control of signals, among other possible reliability-related problems of a heat exchange system. Additionally, corrosion may increase maintenance costs associated with such a heat exchange system.

Effectiveness of cooling by flow of a coolant has a significant dependency on velocity of such coolant within the cooling loop. As is known, for a sufficiently high velocity, turbulent flow of the coolant may be obtained for enhanced cooling. However, an increase in coolant velocity leads to an increase in hydrodynamic losses associated with flow of coolant in a cooling loop. The increase in hydrodynamic losses has generally resulted in an increase in the consumption of energy for operation of the heat exchange systems themselves. Again, while not wishing to be bound by theory, it is believed that corrosion may further increase hydrodynamic losses and thus further increase the consumption of energy.

Accordingly, it would be desirable and useful to provide means to at least reduce the rate of corrosion in a fluid-operated heat exchange system.

SUMMARY OF THE INVENTION

One or more aspects of the invention generally relate to reliability and longevity of a heat exchange system and, more particularly, to use of an inert gas in a fluid-operated heat exchange system.

An aspect of the invention is generally a method for conditioning a cooling loop of a heat exchange system. The cooling loop of the heat exchange system is purged with an inert gas to remove oxygen from the cooling loop. Coolant is added to the cooling loop of the heat exchange system. The coolant flows in the cooling loop of the heat exchange system to mix the inert gas with the coolant to provide a solution having a reduced concentration of oxygen.

Another aspect of the invention is generally a method for conditioning a cooling loop of a heat exchange system. Coolant is added to the cooling loop of the heat exchange system. Oxygen is allowed to collect at and exit from a collection location responsive to adding coolant to the cooling loop of the heat exchange system. The cooling loop of the heat exchange system is purged with an inert gas to remove oxygen from the cooling loop. The coolant in the cooling loop of the heat exchange system flows to mix the inert gas with the coolant to provide a solution having a reduced concentration of oxygen.

Yet another aspect of the invention is generally a thermal cooling module. A heat exchanger is coupled to a reservoir. The heat exchanger and the reservoir coupled to receive a gas for expelling oxygen from a cooling system. The expelling of the oxygen in turn reduces concentration of the oxygen in the cooling system in which the heat exchanger and the reservoir are coupled.

BRIEF DESCRIPTION OF THE DRAWINGS

Accompanying drawing(s) show exemplary embodiment(s) in accordance with one or more aspects of the invention; however, the accompanying drawing(s) should not be taken to limit the invention to the embodiment(s) shown, but are for explanation and understanding only.

DETAILED DESCRIPTION OF THE DRAWINGS

A heat exchange system and conditioning with an inert gas thereof are described. However, in view of the following description, it should be apparent to one skilled in the art that the invention may be practiced without all the specific details given below. In other instances, well known features have not been described in detail so as not to obscure the invention. For ease of illustration, the same number labels are used in different diagrams to refer to the same items; however, in alternative embodiments the items may be different.

Figure 1A:
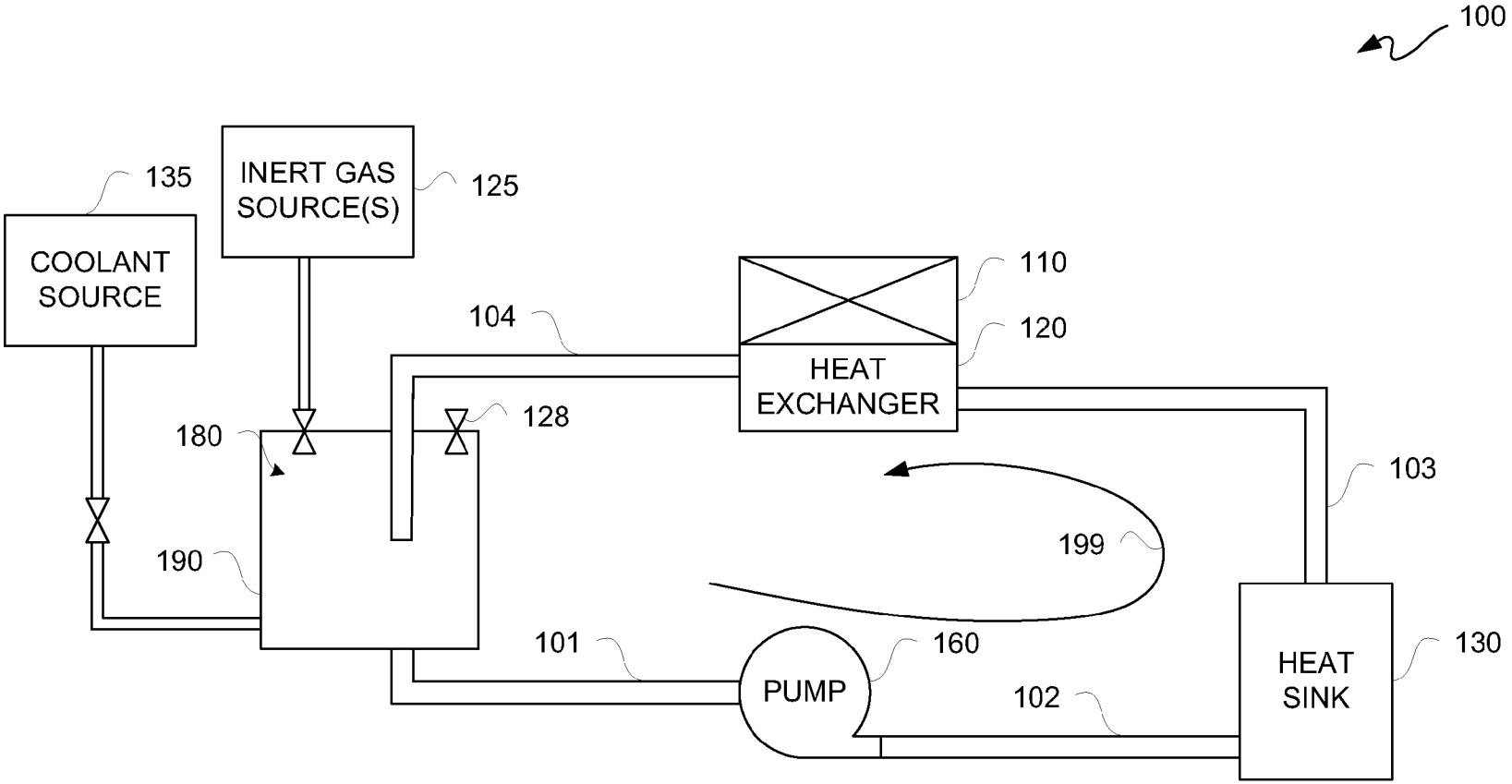
FIG. 1A is a block diagram depicting an exemplary embodiment of a heat exchange system.

FIG. 1A is a block diagram depicting an exemplary embodiment of a heat exchange system 100. Heat exchange system 100 includes heat exchanger 120, fan 110, reservoir 190, pump 160, heat sink 130, one or more inert gas source(s) 125, and coolant source 135. Notably, one or more inert gas source(s) 125 and coolant source 135 may be decoupled from associated valves after a cooling loop 199 has been made ready for operation. Alternatively, one or more of the one or more inert gas source(s) 125 and coolant source 135 may be left coupled to cooling loop 199 of heat exchange system to routinely purge and add coolant, respectively, to cooling loop 199. However, in operation, cooling loop 199 generally includes heat exchanger 120, fan 110, heat sink 130, pump 160, and reservoir 190 when heat exchange system 100 is in use. Within cooling loop 199, prior to conditioning for operation, is principally air 180.

Reservoir 190 may be coupled to pump 160 via pipe 101 for allowing coolant to pass from reservoir 190 to pump 160. Pump 160 may be coupled to heat sink 130 via pipe 102 for allowing coolant to pass from pump 160 to heat sink 130. Pipe 103 may be used for allowing coolant to pass from heat sink 130 to heat exchanger 120. Lastly, pipe 104 may be used for allowing coolant to pass from heat exchanger 120 back to reservoir 190. In addition to passage of coolant via pipes 101 through 104, it should be appreciated that gases may pass through such pipes. Furthermore, it should be appreciated that pipes 101 and 102 are on a "cool" side of cooling loop 199, and pipe 103 is on a "hot" side of cooling loop 199. Pipe 104, which is also on a "cool" side of cooling loop 199, is used to provide cooled coolant from heat exchanger 120 back to reservoir 190 for subsequent reuse by heat sink 130. Coolant flows into reservoir 190 via pipe 104 passing through the top of reservoir 190 and into a volume defined by reservoir 190. However, coolant exits reservoir 190 from the bottom of the volume defined by reservoir 190 into pipe 101. In operation, cooling loop 199 may be a closed-loop heat exchange system 100. Notably, by "closed-loop" as used herein, it is not meant to suggest that heat exchange system 100 has to be sealed so as to be "air tight."

Figure 1B:
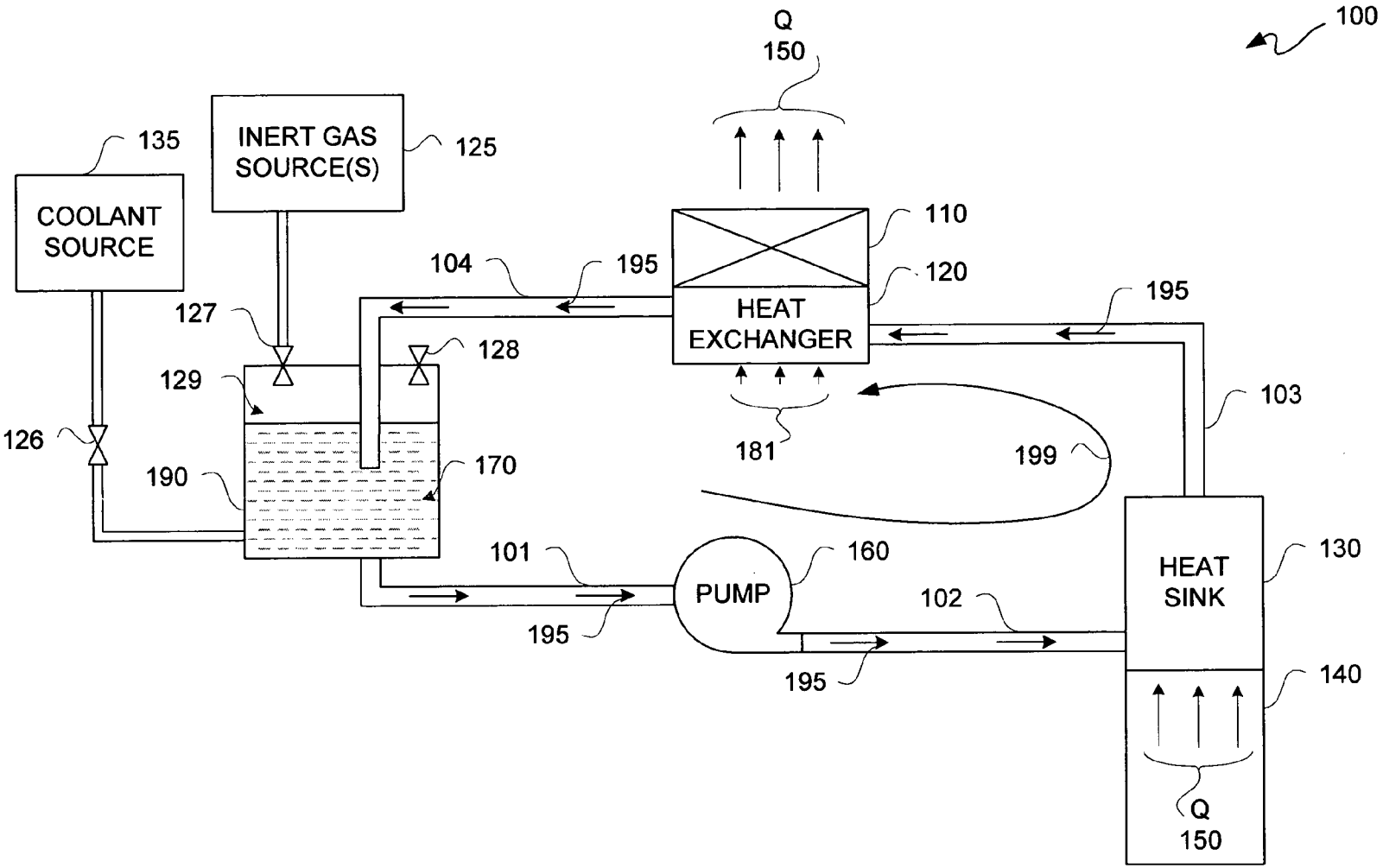
FIG. 1B is the block diagram of FIG. 1A after the heat exchange system of FIG. 1A has been conditioned for operation.

FIG. 1B is the block diagram of FIG. 1A after heat exchange system 100 has been conditioned for operation. More particularly, liquid coolant 170 has been added to cooling loop 199 from coolant source 135 via intake valve 126. Additionally, air 180 of FIG. 1A is purged such that the majority of the gas in cooling loop 199 is one or more inert gases 129 from one or more inert gas source(s) 125. Notably, as used herein, the word "purge" shall mean to remove trapped air or gas in whole or in part." One or more inert gases 129 may be added to cooling loop 199 via intake valve 127. Furthermore, air 180 may be purged from cooling loop 199 via exhaust valve 128. As generally indicated, a heat source 140 may be coupled to heat sink 130 for removal of heat ("Q") 150 by heat exchanger 120 and fan 110. Fan 110 may generate an intake airflow 181 and may be used to exhaust heat 150 from heat exchange system 100 into the surroundings, for example. Arrows 195 indicate a general direction of coolant flow in pipes 101 through 104 of cooling loop 199 during operation of heat exchange system 100. Heat exchange system 100 may include one or more of turbulent, laminar, and boiling flow. Such coolant may be in the form of a gas-liquid, namely a gas in solution with coolant, or a gas-vapor-liquid, namely a gas solution with coolant brought to a boiling flow. Thus, heat exchange system 100 may be a gas-liquid or a gas-vapor-liquid cooling system.

Although a fan 110 is illustratively shown, it should be appreciated that a chiller may be used instead of a fan 110. However, for purposes of clarity and not limitation, it shall be assumed that a fan 110 is used.

Reservoir 190 has in a lower portion thereof coolant 170, and in an upper portion thereof, inert gas 129. Thus, reservoir 190 may be used as a container that allows for coolant to expand due to temperature and, for a generally vertical orientation, as a natural divider of inert gas 129 and coolant 170 for circulation in cooling loop 199.

An exit opening of pipe 104 in reservoir 190 may be below the surface level of coolant 170 in reservoir 190. One or more inert gases 129 may be introduced into cooling loop 199 to reduce the concentration of oxygen therein. By inert gas, it is generally meant that the gas provided to cooling loop 199 is less likely, in comparison to oxygen, to promote corrosion or other form of degradation of either or both coolant 170 or the materials used to provide cooling loop 199. As various types of coolant and materials for forming cooling loop 199 are well known, they are not described in unnecessary detail herein. However, examples of inert gases that generally may be used include nitrogen, argon, and helium, among other known types of gases sufficient for purging oxygen from cooling loop 199. Notably, it is not necessary to use merely one inert gas; rather, a combination of inert gases, serially or at the same time, may be used. For example, a heavier inert gas may be used for a course or initial purge, and a lighter inert gas may be used for a subsequent or finer purge to expel oxygen from cooling loop 199. Notably, not all gas in cooling loop 199 need be inert gas 129 after conditioning.

Inert gas 129 may go into solution with coolant 170 due to circulation of coolant 170 through cooling loop 199, in addition to force of inert gas 129 entering reservoir 190 via intake valve 127. In order to enhance the purging of oxygen from cooling loop 199, it may be desirable to enhance the concentration of inert gas 129 going into a solution with coolant 170.

Figure 1C:
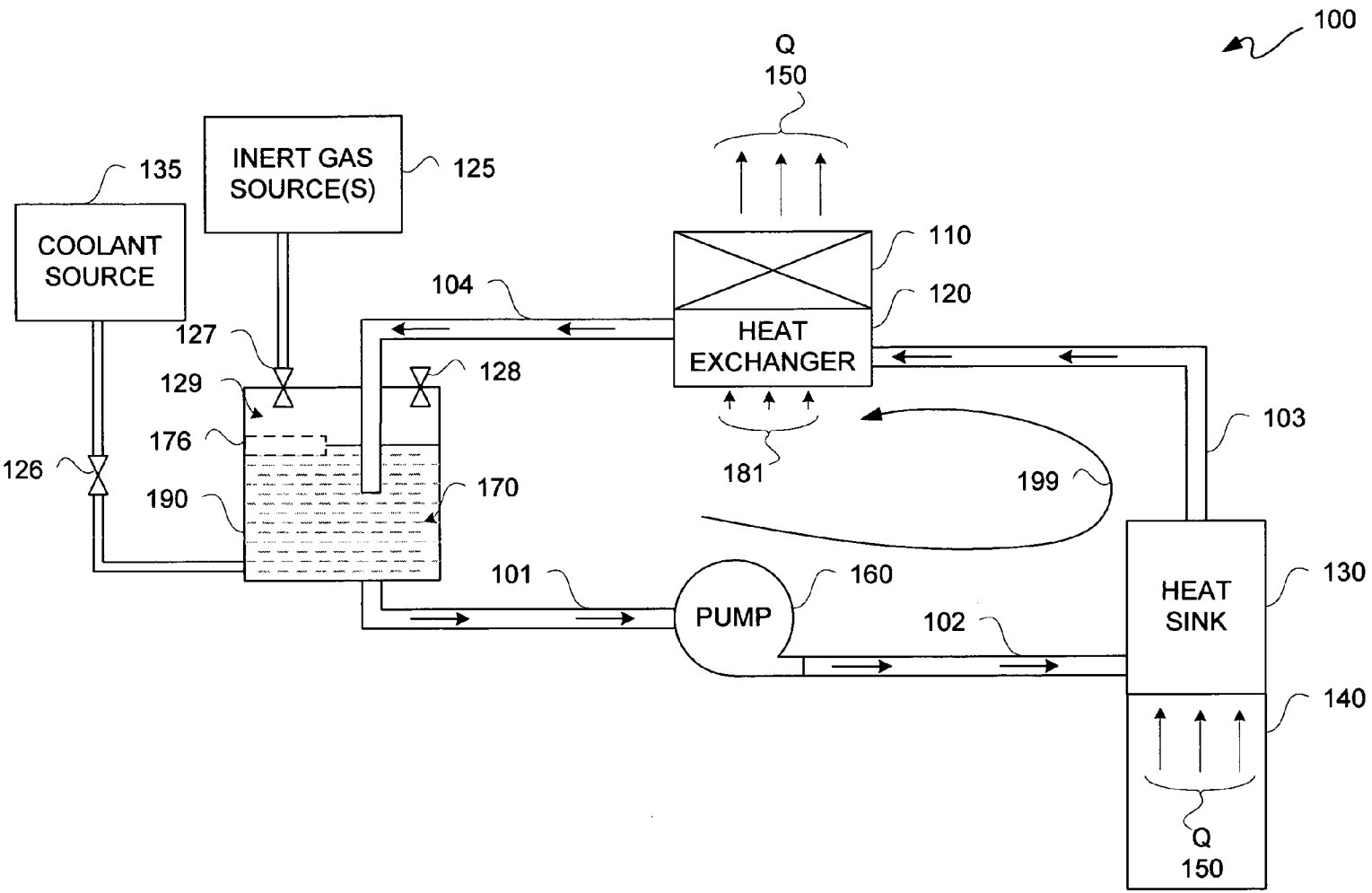
FIG. 1C is the block diagram of FIG. 1B for the heat exchange system of FIGS. 1A and 1B having an optional mechanical agitator.

In FIG. 1C, there is shown the block diagram of FIG. 1B for heat exchange system 100 having an optional mechanical agitator 176. Mechanical agitator 176, which may operate responsive to force of inert gas 129 entering reservoir 190, or may be separately powered, may be used to agitate coolant 170 to promote inert gas 129 going into solution therewith. Thus, it should be appreciated that concentration of oxygen in a gas state may be reduced and concentration of oxygen in solution may be reduced as described below.

For purposes of clarity by way of example and not limitation, it shall be assumed that a single inert gas 129, namely nitrogen, is used. Nitrogen, when circulated in cooling loop 199 as part of operation of heat exchange system 100, may go into solution with coolant 170 in the form of a dissolved gas forming micro-bubbles. Furthermore, while not wishing to be bound by theory, it is believed that the speed of propagation of acoustic waves is significantly lower and acoustic attenuation is significantly higher in a bubbly liquid than in a "clear" or non-bubbly liquid. Accordingly, a bubbly liquid may enhance reliability and longevity of a heat exchange system. Furthermore, while not wishing to be bound by theory, it is believed that the degree of local turbulence is significantly higher in a multiphase flow than in an equivalent single-phase flow when using a bubbly flow. Thus, the rate of transfer of heat from coolant 170 to inner walls of cooling loop 199, namely "wall-flow" heat transfer, may be considerably increased without significant increase in consumption of energy for transport of coolant.

Figure 2:
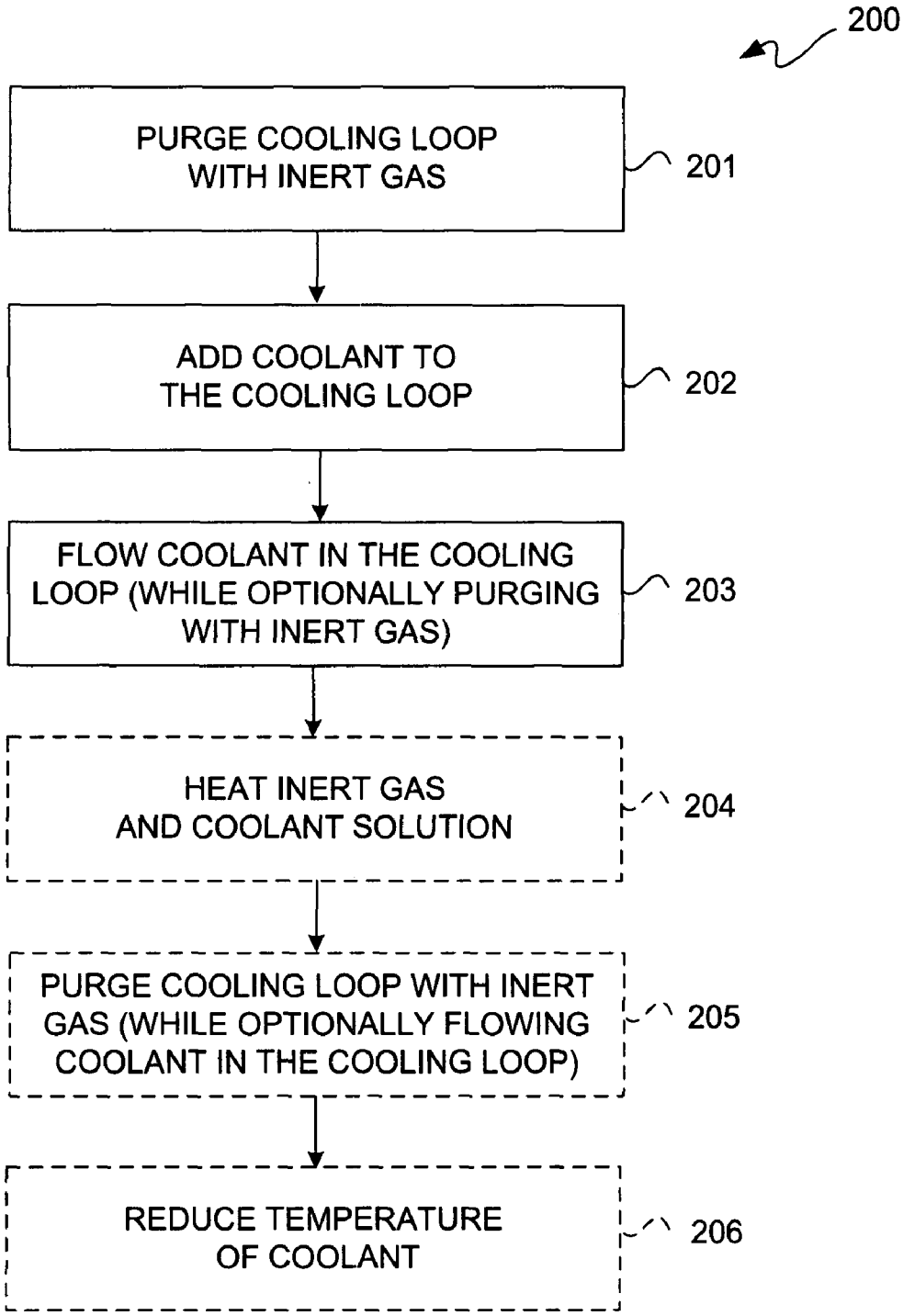
FIG. 2 is a flow diagram depicting an exemplary embodiment of a purge and fill flow for conditioning a cooling loop of FIGS. 1A through 1C.

FIG. 2 is a flow diagram depicting an exemplary embodiment of a purge and fill flow 200 for conditioning cooling loop 199 of FIGS. 1A through 1C. With simultaneous reference to FIGS. 1A through 1C and 2, purge and fill flow 200 is further described.

At 201, cooling loop 199 is purged with inert gas 129 entering via intake valve 127. This purging is to remove or at least substantially reduce the concentration of oxygen in cooling loop 199. Oxygen in cooling loop 199 may exit via exhaust valve 128.

At 202, coolant 170 is added to cooling loop 199 via valve 126. Notably, coolant 170 need not, and in this example does not, completely fill cooling loop 199.

At 203, coolant 170 is flow-circulated in cooling loop 199. Notably, there may be some amount of air, or more particularly oxygen, in solution with coolant 170 as obtained from coolant source 135. This may be due to air mixing with coolant, or coolant composition, or both. Accordingly, coolant 170 may be flow-circulated in cooling loop 199 while optionally purging with inert gas 129 obtained from inert gas source(s) 125, where exhaust valve 128 may be opened as a release value, and may more particularly be configured as a pressure release valve. Purging while coolant 170 is circulated may facilitate additional removal of oxygen from cooling loop 199, or may positively affect the relative concentration of the inert gas-to-oxygen ratio in solution with coolant 170, or a combination of both. While not wishing to be bound by theory, it is believed that by increasing the amount of concentration of inert gas 129 in coolant 170, corrosion caused by any residual oxygen in solution with coolant 170 may be inhibited or at least significantly slowed.

Optionally, in addition to operations 201 through 203, one or more of optional operations 204 through 206 may be implemented. For example, at 204, the inert gas and coolant solution may be heated, apart from application of heat source 140, as part of preconditioning cooling loop 199 for use with heat source 140. This heating may be implemented in order to increase the amount of kinetic energy in the coolant solution such that oxygen is expelled from such coolant solution. Notably, the heating of the inert gas and coolant solution may be done at least in part by applying an external heat source to cooling loop 199 of heat exchange system 100.

Additionally, at 205, another purging with inert gas 129 may optionally be done while optionally flow-circulating coolant 170. After removing additional oxygen by heating coolant 170, temperature of such coolant solution may optionally be rapidly reduced at 206 to further precondition cooling loop 199 for use by application of an external chiller to cooling loop 199. While not wishing to be bound by theory it is believed that rapid cooling may mitigate against remaining oxygen going back into solution with coolant 170.

As previously described, a different inert gas may be used for the optional second purging at 203 or for the optional third purging at 205, or both, which has less atomic mass than the inert gas used for the first purging at 201. Alternatively, the same inert gas may be used for all purges, or the inert gas with the lighter atomic mass may be used at the initial purging at 201, followed by purging with the inert gas of greater atomic mass at 203 or 205, or both.

Furthermore, it should be appreciated that coolant solution at 202 may have a different concentration of oxygen than the coolant solution at 203. Likewise, coolant solution at 203 may have a different oxidation concentration than coolant solution at 206. Thus, it should be appreciated that the concentration of oxygen in coolant solution may be progressively decreased. Furthermore, it should be appreciated that the purging initiated at 201 may be continuous. That is, the purging may continue through the addition of coolant at 202, through the flowing of coolant at 203, and so on, such that what is depicted in purge and fill flow 200 is implemented as a single, continuous purge bridging at least two purging operations, such as purging at 201 and 203, or 203 and 205, or 201, 203, and 205.

Figure 3:
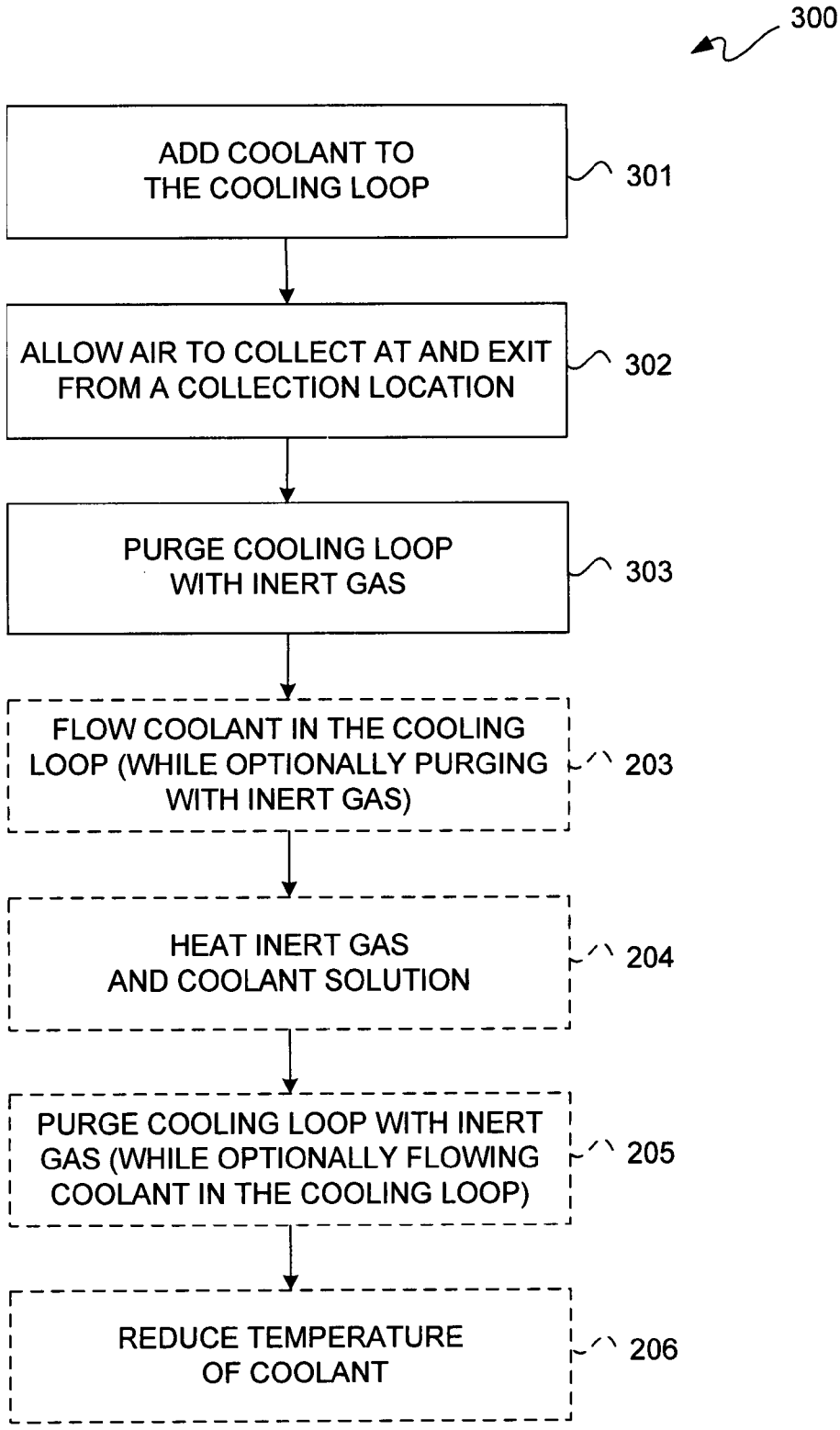
FIG. 3 is a flow diagram depicting an exemplary embodiment of a fill and purge flow for conditioning a cooling loop of FIGS. 1A through 1C.

FIG. 3 is a flow diagram depicting an exemplary embodiment of a fill and purge flow. With simultaneous reference to FIGS. 1A through 1C and 3, fill and purge flow 300 is further described.

At 301, coolant 170 is added to cooling loop 199. Notably, coolant 170 added at 301 may completely or partially fill cooling loop 199. A location, such as within reservoir 190, may be used as a gas-gathering region. Thus, at 302, some time may be allowed for air to collect at such region. Cooling loop 199 may be subsequently purged with inert gas 129 at 303.

Optionally, one or more of operations 203 through 206 as previously described with respect to purge and fill flow 200 of FIG. 2 may be used with fill and purge flow 300.

Furthermore, as previously described, the purge operation at 303 may be discrete or may be a continuous purge with at least the optional purge at 203 or both optional purges 203 and 205 of fill and purge flow 300.

Figure 4:
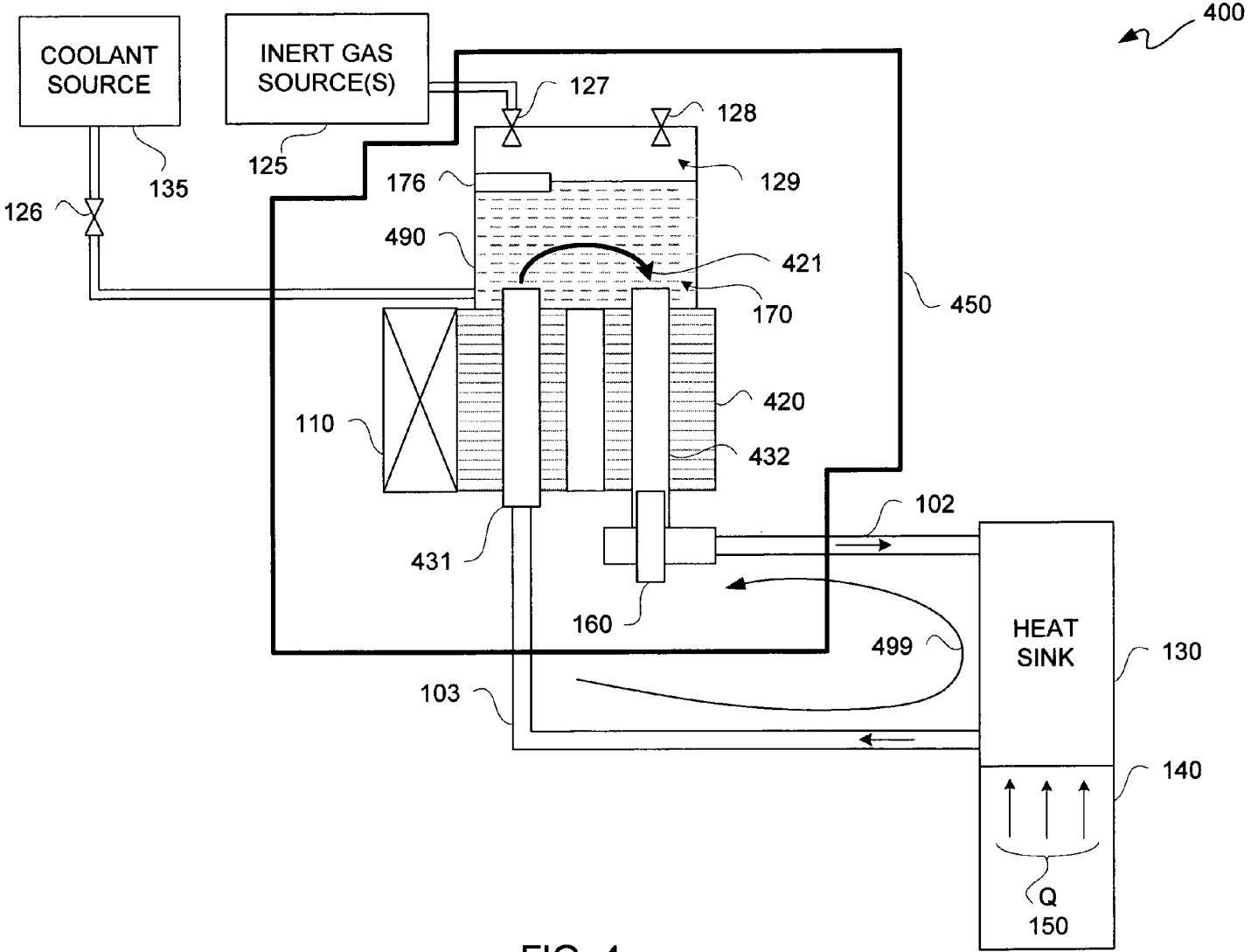
FIG. 4 is a block diagram depicting an exemplary embodiment of a heat exchange system.

FIG. 4 is a block diagram depicting an exemplary embodiment of a heat exchange system 400. The description of components of heat exchange system 400 that are similar to those of heat exchange system 100 is not repeated for purposes of clarity.

Heat exchange system 400 includes heat exchanger 420 and reservoir 490. Heat exchanger 420 may have mounted to it one or more of reservoir 490, fan 110, and pump 160 in order to provide a more compact cooling loop 499. Cooling loop 499 is more compact than cooling loop 199 of FIGS. 1A through 1C.

Along those lines, reservoir 490, heat exchanger 420, fan 110, and pump 160 may be assembled as one compact thermal exchange module 450. Accordingly, thermal exchange module 450 may be coupled to a heat sink 130 after being preconditioned for operation as previously described using one or more inert gas source(s) 125 and coolant source 135. Notably, thermal exchange module 450 does not need to be preconditioned with inert gas 129 as previously described. For example, thermal exchange module 450 may be purged with at least one inert gas 129 after initiating operation thereof. However, for purposes of clarity, it shall be assumed that thermal exchange module 450 has been preconditioned by use of at least one inert gas 129 as previously described after coupling to heat sink 130.

In operation, heat source 140, which may be any of a variety of known heat sources, generates heat which is carried away from heat source 140 by flowing coolant through heat sink 130. Heat 150 generated by heat source 140 may be dissipated to a surrounding environment by thermal exchange module 450. While it has been assumed that a pump 160 has been used for thermal exchange module 450, it should be appreciated that another type of device used to originate flow of coolant 170 may be used. Alternatively, natural convection or flow of coolant 170 may be used with or without the aid of a pump or other device used to originate flow of coolant 170.

Reservoir 490 is located above heat exchanger 420. Furthermore, reservoir 490 may have an inlet and an outlet on a bottom thereof for engagement with inlet pipe 431 and outlet pipe 432, respectively. Thus, flow as indicated by arrow 421 of coolant 170 from inlet pipe 431 to outlet pipe 432 may be provided via passing through reservoir 490. Heat exchanger 420 and reservoir 490 may be assembled as one assembly by a manufacturer. In the embodiment illustratively shown, there is serial flow of coolant in inlet pipe 431 and serial flow of coolant in outlet pipe 432 of heat exchanger 420. However, it should be appreciated that one or more of inlet pipe 431 and outlet pipe 432 may each be shaped, such as in a serpentine pattern, for parallel flow within either or both of inlet pipe 431 and outlet pipe 432. Taken together, flow through inlet pipe 431 and outlet pipe 432 is parallel flow in heat exchanger 420.

Figure 5:
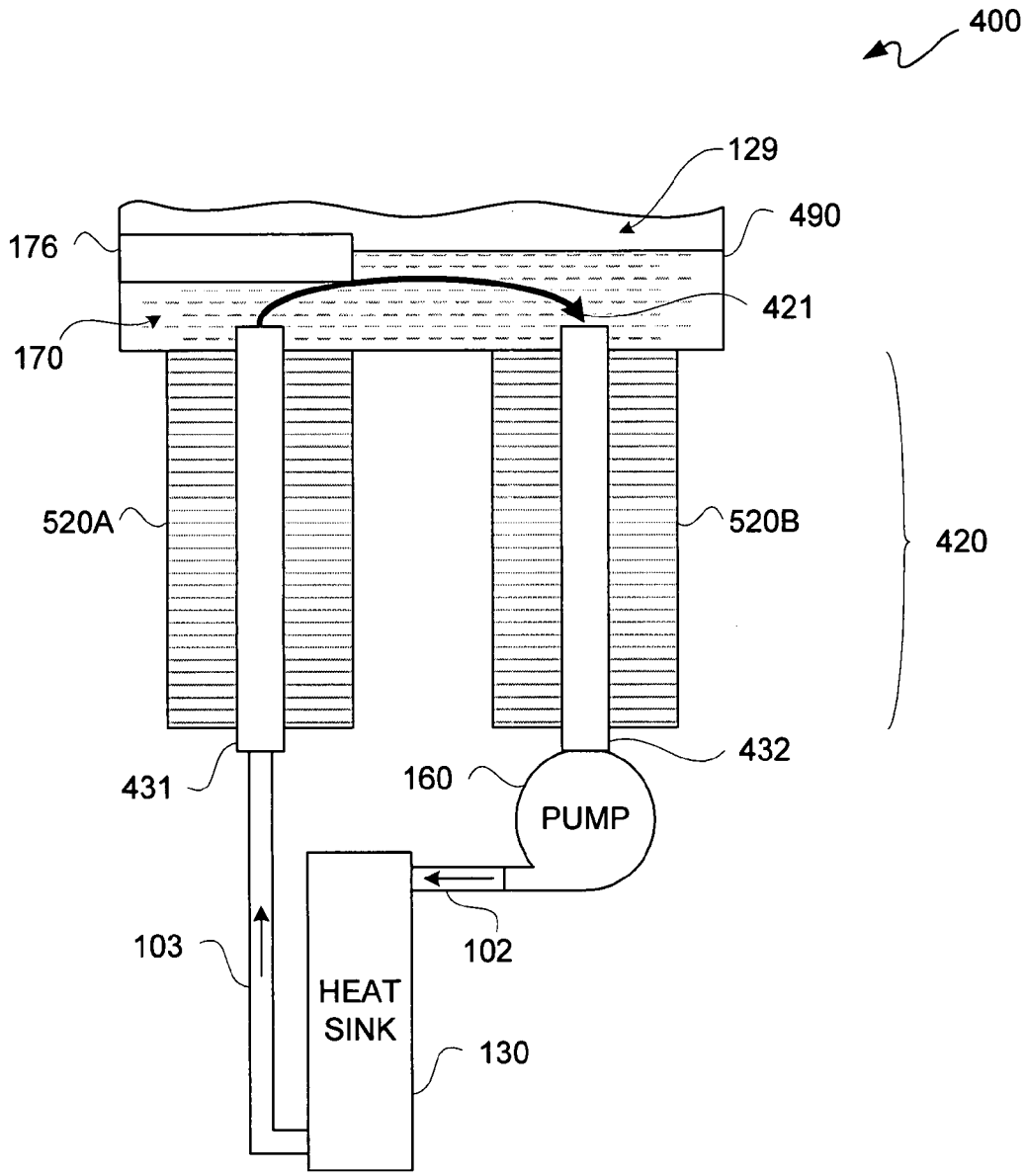
FIG. 5 is a side view of a portion of the heat exchange system of FIG. 4.

FIG. 5 is a side view of a portion of heat exchange system 400 of FIG. 4. As illustratively shown, heat exchanger 420 includes at least two separate heat exchanger cooling stacks 520A and 520B. Cooling stacks 520A and 520B of heat exchanger 420 form a pair for the passage of fluid from inlet pipe 431 to outlet pipe 432, as indicated by arrow 421. Thus, it should be appreciated that inlet pipe 431 and outlet pipe 432 are coupled via reservoir 490 for inlet-to-outlet flow of coolant 170. Thus, it should be appreciated that reservoir 490 is common to both inlet pipe 431 and outlet pipe 432.

While the top portions or openings of inlet pipe 431 and outlet pipe 432 share reservoir 490, the bottom portions of inlet pipe 431 and outlet pipe 432 are coupled via pump 160 and heat sink 130, as well as pipes 102 and 103. More particularly, heat sink 130 is coupled to a bottom portion of inlet pipe 431 via pipe 103; a bottom portion of outlet pipe 432 is coupled to an inlet of pump 160; and an outlet of pump 160 is coupled to heat sink 130 via pipe 102. While a single pair of cooling stacks formed of cooling stacks 520A and 520B is illustratively shown, it should be appreciated that multiple pairs of cooling stacks may be used to provide heat exchanger 420. In the embodiment illustratively shown in FIGS. 6A and 6B below, a heat exchanger 620 is illustratively shown as having two pairs of cooling stacks.

With continuing reference to FIG. 5, notably, by having tops of inlet pipe 431 and outlet pipe 432 intersect a bottom portion of a reservoir 490, coolant 170 is separated from gas 129 merely by maintaining a sufficient level of coolant 170. While not wishing to be bound by theory, it is believed that by having coolant 170 flow from inlet pipe 431 and into outlet pipe 432 at or near the bottom of reservoir 490, as opposed to having one or both of an exit opening of inlet pipe 431 and an inlet opening of outlet pipe 432 not at or near the bottom of reservoir 490, that separation of coolant 170 and inert gas 129 is more readily facilitated and maintained to allow for thermal expansion of coolant 170. Additionally, a gas-liquid agitator or mixer 176 may be located at least partially in reservoir 490 sufficient for mixing or combining inert gas 129 with coolant 170 to form an inert gas-liquid solution. This agitation or mixing may be useful for providing micro-bubbles of inert gas 129 in a liquid coolant 170 for reasons as previously described.

Thus, it should be appreciated that at least a heat exchanger and a reservoir as described herein may be formed as a single compact unit. Furthermore, one or both of a fan and a pump may be added to form a single compact unit with the heat exchanger and the reservoir. Additionally, in order to provide an off-the-shelf product or a single-unit system, a heat sink may be coupled to a single compact thermal exchange module having at least a pump, a heat exchanger, and a reservoir as described herein. Such a single-unit system may be preconditioned by a purge and fill, or fill and purge, as described herein with reference to FIGS. 2 and 3, respectively. Such a preconditioned single-unit system may be sealed to reduce possibility of leakage.

Figure 6A:
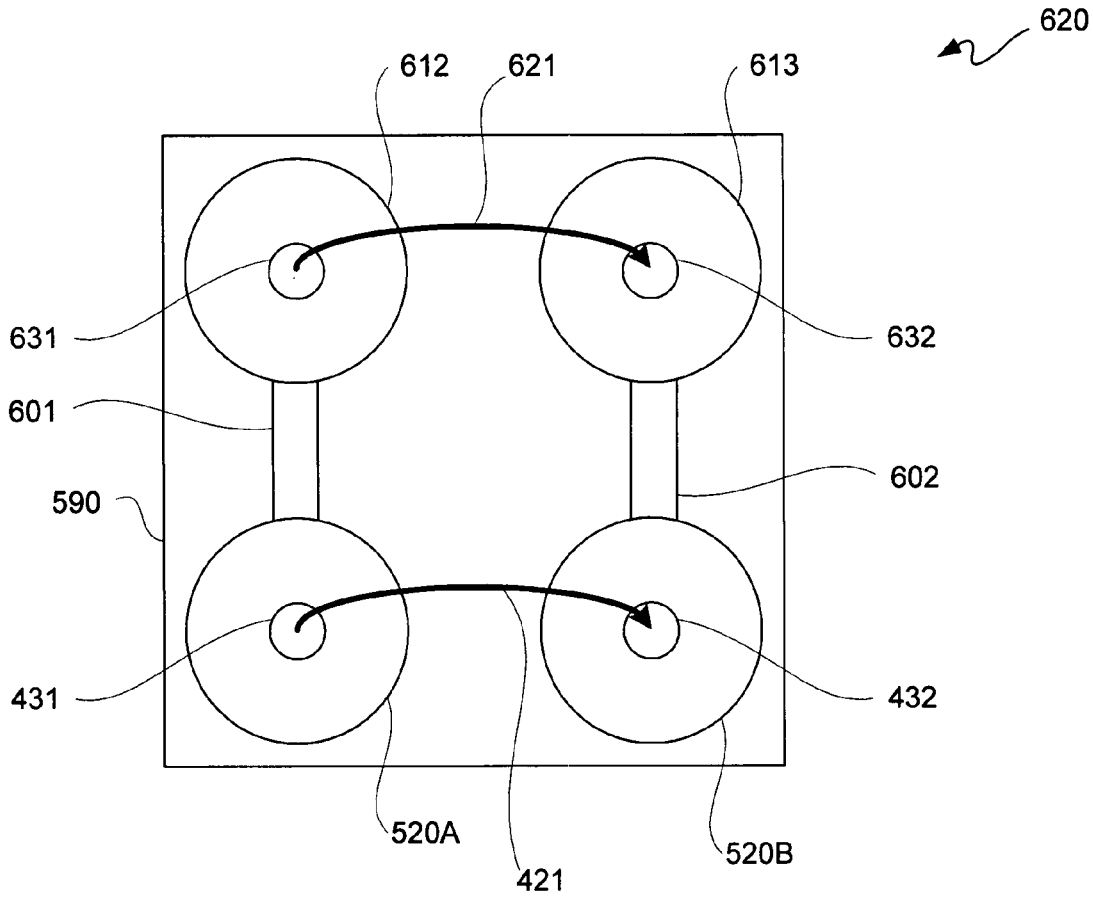
FIG. 6A is a top-view block diagram depicting an exemplary embodiment of a heat exchanger having two pairs of cooling stacks.
Figure 6B:
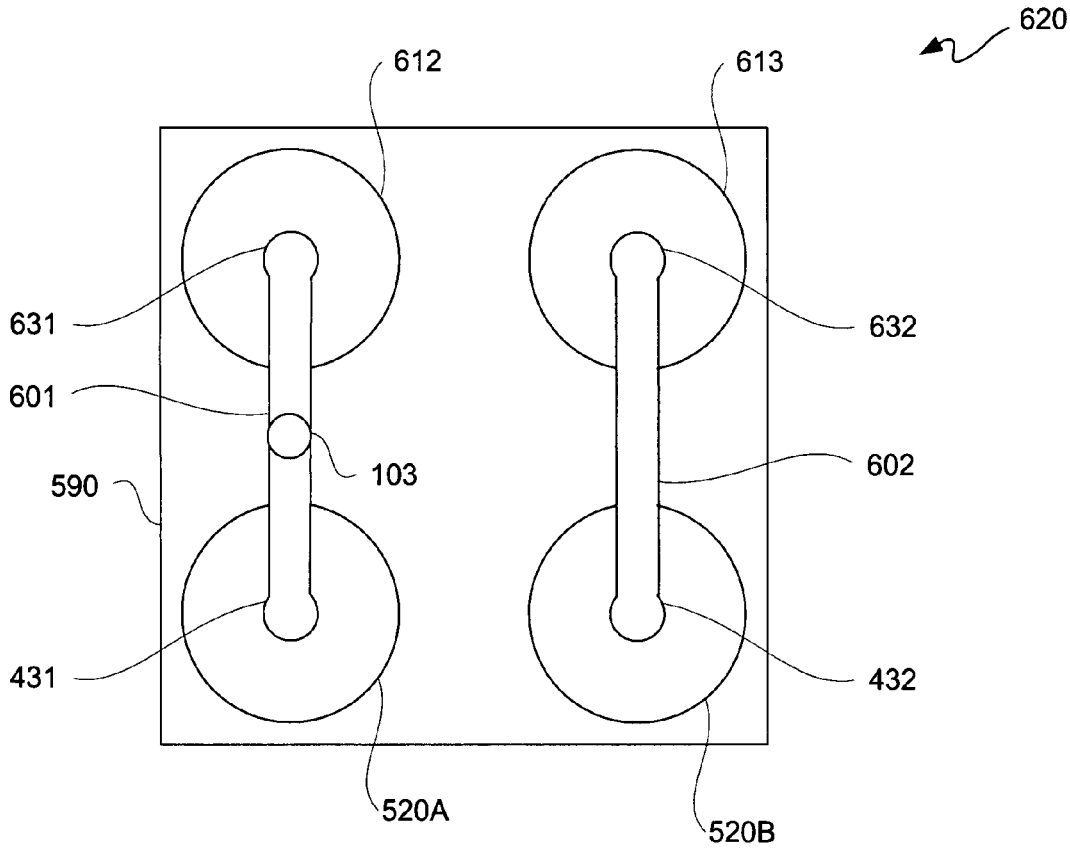
FIG. 6B is a bottom-view block diagram depicting the heat exchanger of FIG. 6A.

FIG. 6A is a top-view block diagram depicting an exemplary embodiment of a heat exchanger 620 having two pairs of cooling stacks, namely a pair of cooling stacks 520A and 520B and a pair of cooling stacks 612 and 613. FIG. 6B is a bottom-view block diagram depicting heat exchanger 620 of FIG. 6A. With simultaneous reference to FIGS. 4, 5, 6A, and 6B, heat exchanger 620 is further described.

Heat exchanger 620, which may be used in heat exchange system 400 of FIGS. 4 and 5 instead of heat exchanger 420, may be thought of as two heat exchangers 420 coupled in parallel. Thus, flow is generally from inlet pipe 431 to outlet pipe 432 as generally indicated by arrow 421 within reservoir 590, and another flow within reservoir 590 is generally from inlet pipe 631 to outlet pipe 632 respectively of cooling stacks 612 and 613. This second flow is generally illustratively shown by arrow 621. Of course, fluid entering reservoir 590 from inlet pipe 431 and 631 mixes with coolant already in reservoir 590 prior to flowing into outlet pipe 432 and 632.

Inlet pipe 601 may be used to couple inlet pipes 431 and 631, and outlet pipe 602 may be used to couple outlet pipes 432 and 632. Furthermore, an outlet of pipe 103 illustratively shown in cross-section in FIG. 6B may be coupled to inlet pipe 601, and an inlet of pipe 102 may be coupled to outlet pipe 602 via pump 160 of FIG. 5 (not shown in FIG. 6B).

Thus, for heat exchanger 620, multiple cooling stacks, which may be arranged in parallel or series, may be serviced by a single fan 110. Furthermore, each inlet, such as inlet pipes 431 and 631, has an associated outlet, such as outlet pipes 432 and 632, respectively, and passage of fluid in both inlet pipes and outlet pipes is exposed to movement of air across exterior surfaces thereof or fins associated therewith, or both, for purposes of cooling. In other words, cooling efficiency is enhanced by effectively providing parallel cooling with respect to airflow across pipes of separate cooling stacks. Again, although each inlet pipe and outlet pipe, such as inlet pipes 431 and 631 and outlet pipes 432 and 632, are illustratively shown as serial-flow-oriented, flow within individual cooling stacks may be parallel by forming one or both of inlet pipes 431 and 631 or and one or both of outlet pipes 432 and 632 as a serpentine-shaped pipe having an ingress at the bottom of such cooling stack and an egress at the top of such cooling stack with respect to inlet pipes, and the converse with respect to outlet pipes.

Figure 7:
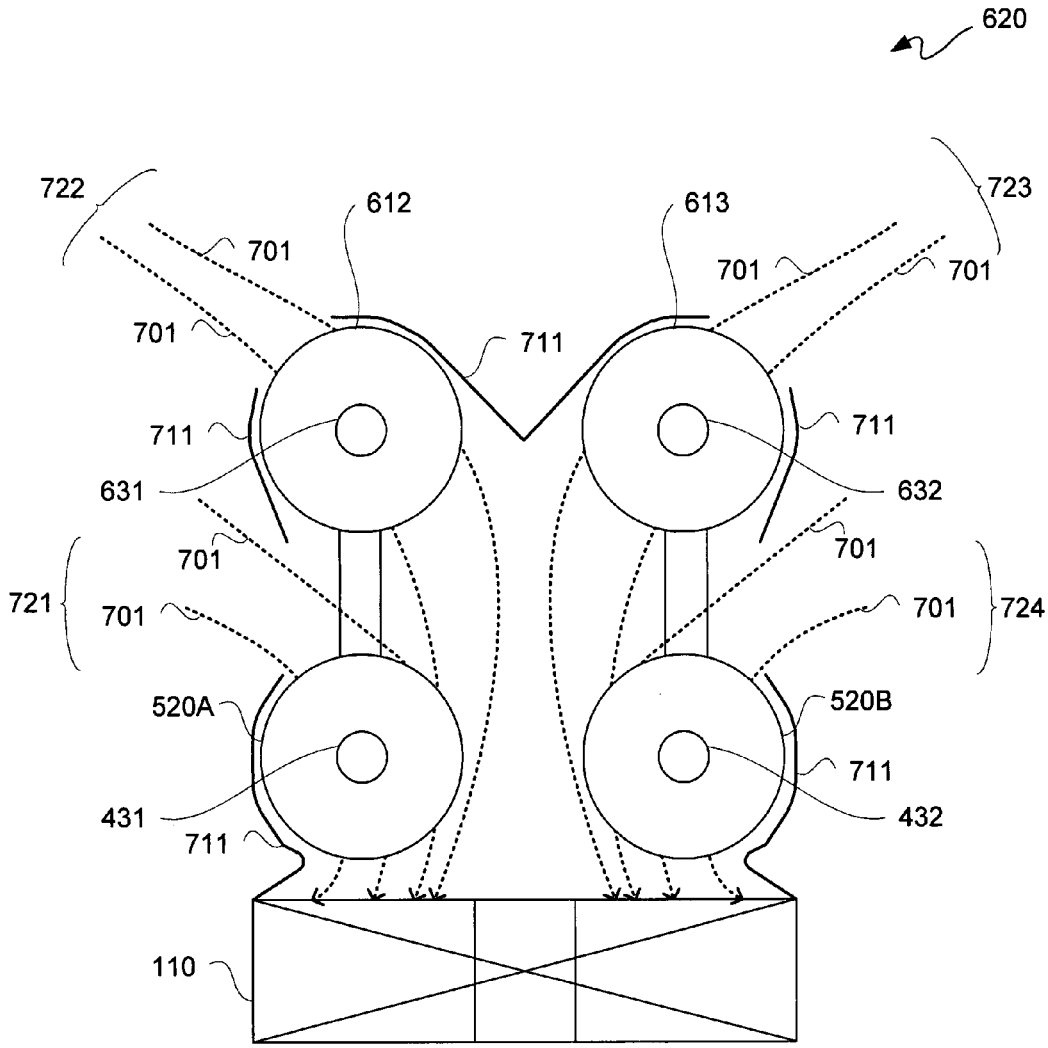
FIG. 7 is a top-view block diagram depicting an exemplary embodiment of a heat exchanger coupled to a fan.

FIG. 7 is a top-view block diagram depicting an exemplary embodiment of heat exchanger 620 coupled to fan 110. Baffles 711 may be used to deflect intake airflow into heat exchanger 620. The placement and shaping of baffles 711 as illustratively shown in FIG. 7 is not the only possible configuration but is only for purposes of clarity by way of example and not limitation, and other configurations may be used. Accordingly, baffles 711 may define respective airflow ingress openings 721 through 724. Additionally, baffles 711 may form a housing for partially enclosing cooling stacks 520A, 520B, 612 and 613.

As illustratively shown by dotted lines 701, air may be pulled into heat exchanger 620 responsive to operation of fan 110 as an intake fan. Baffles 711 may be used to deflect air in order to form various airstreams passing by cooling stacks 520A, 520B, 612, and 613. Accordingly, it should be appreciated that heat exchanger 620, or heat exchanger 420 of FIG. 4, by having separate cooling stacks formed in pairs, allows air drawn in by fan 110 to pass by each of such stacks separately. By having at least two separate cooling stacks, heat exchanger 420 or 620 have separate airflows to enhance cooling efficiency in comparison with unsegregated cooling stacks. Notably, cooling stacks may have fins of various diameters or lengths, or both, to tailor exposure to airflow within heat exchanger 420 or 620.

Thus, coolant 170 may enter heat exchanger 620 and be separated into inlet pipes 431 and 631. Such coolant 170 may be separately cooled in segregated cooling stacks 520A and 612 and then recombined in reservoir 590. Such recombined, cooled coolant 170 in reservoir 590 may be separated again for cooling in segregated cooling stacks 520B and 613 and then recombined after exiting outlet pipes 432 and 632 for purposes of pumping.

Each of cooling stacks 520A, 520B, 612, and 613 may be spaced apart from one another in order to facilitate airflow between them. Additionally, although two inlet and two outlet cooling stacks are illustratively shown with respect to heat exchanger 620, it should be appreciated for example that there may be two inlet cooling stacks and only one outlet stack. Alternatively, there may be only one inlet cooling stack and two outlet cooling stacks. The ability to have a common reservoir allows for various inlet-to-outlet cooling stack ratios and low pressure drops within such reservoir. Furthermore, it should be appreciated that heat exchanger 620 or 420 may be used in a gas-vapor-liquid cooling environment or a gas-liquid environment, as previously described.

While the foregoing describes exemplary embodiment(s) in accordance with one or more aspects of the invention, other and further embodiment(s) in accordance with the one or more aspects of the invention may be devised without departing from the scope thereof, which is determined by the claim(s) that follow and equivalents thereof. For example, known materials other than those specifically listed herein may be used.

Claim(s) listing steps do not imply any order of the steps. Trademarks are the property of their respective owners.

What is claimed is:

1. A method for conditioning a cooling loop of a heat exchange system, comprising:

first purging the cooling loop of the heat exchange system with a first inert gas to remove some oxygen from the cooling loop;

adding coolant to the cooling loop of the heat exchange system;

flowing the coolant in the cooling loop of the heat exchange system to mix the first inert gas with the coolant to provide a first solution having a first concentration of oxygen;

second purging the cooling loop of the heat exchange system with a second inert gas to provide a second solution; and the second solution having a second concentration of oxygen, the second concentration of oxygen being lower than the first concentration of oxygen.

2. The method according to claim 1, wherein the first inert gas and the second inert gas are the same.

3. The method according to claim 1, further comprising heating the first solution for the second purging of the cooling loop of the heat exchange system.

4. The method according to claim 1, wherein the second purging is done at least in part during the flowing of the coolant in the heat exchange system.

5. The method according to claim 1, wherein the first purging and the second purging are done as one continuous purge.

6. A method for conditioning a cooling loop of a heat exchange system, comprising:

adding coolant to the cooling loop of the heat exchange system;

allowing oxygen to collect at and exit from a collection location responsive to the adding of the coolant to the cooling loop of the heat exchange system;

first purging the cooling loop of the heat exchange system with a first inert gas to remove some oxygen from the cooling loop;

flowing the coolant in the cooling loop of the heat exchange system to mix the first inert gas with the coolant to provide a first solution having a first concentration of oxygen;

second purging the cooling loop of the heat exchange system with a second inert gas to provide a second solution; and the second solution having a second concentration of oxygen, the second concentration of oxygen being lower than the first concentration of oxygen.

7. The method according to claim 6, wherein the first inert gas and the second inert gas are the same.

8. The method according to claim 6, further comprising heating the first solution prior to the second purging of the cooling loop of the heat exchange system.

9. The method according to claim 6, wherein the second purging is done at least in part during the flowing of the coolant in the heat exchange system.

10. The method according to claim 6, wherein the first purging and the second purging are done as one continuous purge.

* * * * *